US009022522B2

(12) United States Patent
Hori

(10) Patent No.: US 9,022,522 B2
(45) Date of Patent: May 5, 2015

(54) LIQUID EJECTING APPARATUS AND METHOD FOR DETECTING FOREIGN MATTER

(71) Applicant: Seiko Epson Corporation, Tokyo (JP)

(72) Inventor: Naoki Hori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/153,980

(22) Filed: Jan. 13, 2014

(65) Prior Publication Data

US 2014/0198152 A1 Jul. 17, 2014

(30) Foreign Application Priority Data

Jan. 17, 2013 (JP) ..... 2013-006422

(51) Int. Cl.
*B41J 2/165* (2006.01)
*B41J 11/00* (2006.01)

(52) U.S. Cl.
CPC ..... *B41J 11/002* (2013.01); *B41J 11/0095* (2013.01)

(58) Field of Classification Search
CPC .... B41J 2/165; B41J 2/16508; B41J 2/16526; B41J 2/16535; B41J 2/16547; B41J 2/16552; B41J 2/16585; B41J 2/1714; B41J 2/185; B41J 2/20; B41J 2002/1742
USPC ..... 347/22, 34, 101–104; 101/425; 271/265.04; 399/21
See application file for complete search history.

(56) References Cited

U.S. PATENT DOCUMENTS

| | | | | |
|---|---|---|---|---|
| 5,524,805 | A * | 6/1996 | Shiba et al. | 226/108 |
| 2001/0022601 | A1* | 9/2001 | Ishii et al. | 347/55 |
| 2004/0075213 | A1* | 4/2004 | Obama et al. | 271/258.01 |
| 2009/0127771 | A1* | 5/2009 | Obuchi | 271/207 |
| 2009/0168056 | A1* | 7/2009 | Nakamura et al. | 356/237.4 |
| 2009/0244169 | A1* | 10/2009 | Kojima | 347/22 |
| 2010/0117295 | A1* | 5/2010 | Miyamoto | 271/265.04 |
| 2011/0001783 | A1* | 1/2011 | Fujisawa | 347/102 |
| 2011/0220305 | A1* | 9/2011 | Tsuchihashi et al. | 162/4 |

FOREIGN PATENT DOCUMENTS

| | | |
|---|---|---|
| JP | 05-113325 | 5/1993 |
| JP | 06-040604 | 2/1994 |
| JP | 08-165039 | 6/1996 |
| JP | 2007-072885 | 3/2007 |
| JP | 2007-085960 | 4/2007 |
| JP | 2009-154088 | 7/2009 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid ejecting apparatus includes: a transportation section that transports a medium in a transportation direction; a head that ejects the liquid on the medium; a support member that supports the medium which is in a position facing the head while abutting a surface of one side of the medium; a heat source that is disposed in a position facing the support member; an abutting member that abuts the surface of the one side of the medium on an upstream side from the support member in the transportation direction; and a detection section that detects presence or absence of the foreign matter on a surface of the other side of the medium in an area of the medium which abuts the abutting member.

9 Claims, 4 Drawing Sheets

LIQUID EJECTING APPARATUS AND METHOD FOR DETECTING FOREIGN MATTER

BACKGROUND

1. Technical Field

The present invention relates to a liquid ejecting apparatus and a method for detecting foreign matter.

2. Related Art

An ink jet type printer which forms an image on a medium by ejecting ink (a type of liquid) from a head is known as a liquid ejecting apparatus. In such a printer, a support member (platen) for supporting the medium is provided in a position facing the head.

In such a printer, if foreign matter such as dust is present on the medium, since there is a concern that the head may be damaged by colliding with the foreign matter, it is preferable that presence or absence of the foreign matter be detected. As an apparatus for detecting the presence or absence of the foreign matter, for example, an optical sensor such as disclosed in JP-A-2007-85960 is known.

As the printer described above, there is a printer including a heat source (for example, an irradiation section of UV, a heater, a hot air blowing section or the like) for fixing the ink on the medium after the ink is landed on the medium. In such a printer, a peripheral temperature of the sensor is changed by heat generated from the heat source or heat released from a support member which is heated by the heat source. Such a sensor has temperature characteristics and there is a concern that accuracy of the sensor is deteriorated and then detection accuracy of the foreign matter is reduced by change in the peripheral temperature of the sensor.

SUMMARY

An advantage of some aspects of the invention is to improve detection accuracy of the foreign matter.

According to an aspect of the invention, there is provided a liquid ejecting apparatus including: a transportation section that transports a medium in a transportation direction; a head that ejects the liquid on the medium; a support member that supports the medium which is in a position facing the head while abutting a surface of one side of the medium; a heat source that is disposed in a position facing the support member; an abutting member that abuts the surface of the one side of the medium on an upstream side from the support member in the transportation direction; and a detection section that detects presence or absence of the foreign matter on a surface of the other side of the medium in an area of the medium which abuts the abutting member.

Other features of the invention will be apparent by description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
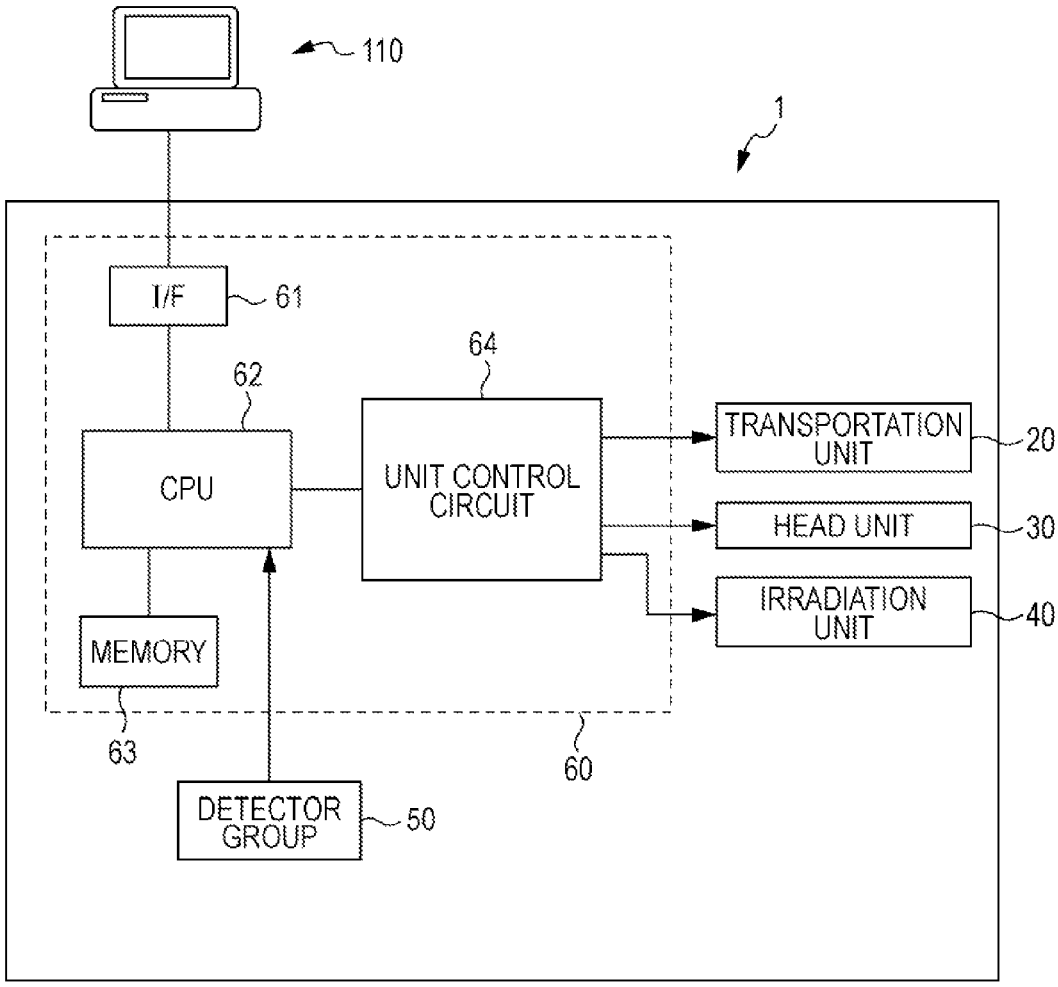
FIG. 1 is a block diagram of an overall configuration of a printer.

At least the following matters will be made clear by description of this specification and the accompanying drawings.

It is clear that a liquid ejecting apparatus includes: a transportation section that transports a medium in a transportation direction; a head that ejects liquid on the medium; a support member that supports the medium which is in a position facing the head while abutting a surface of one side of the medium; a heat source that is disposed in a position facing the support member; an abutting member that abuts the surface of the one side of the medium on an upstream side from the support member in the transportation direction; and a detection section that detects presence or absence of the foreign matter on a surface of the other side of the medium in an area of the medium which abuts the abutting member.

Therefore, it is possible to improve the detection accuracy of the foreign matter.

In such a liquid ejecting apparatus, it is preferable that a thermal expansion coefficient of the abutting member be smaller than that of the support member.

According to such a liquid ejecting apparatus, since amount of change in a thickness of the abutting member due to influence of the heat from the heat source is small, it is possible to further increase in determination accuracy of the foreign matter.

In such a liquid ejecting apparatus, a material of the support member may be aluminum and a material of the abutting member may be iron.

In such a liquid ejecting apparatus, it is preferable that the liquid be cured by receiving radiation of light, and the liquid ejecting apparatus further include: an irradiation section of the light as a heat source.

According to such a liquid ejecting apparatus, it is possible to improve the detection accuracy of the foreign matter regardless of the influence of the heat due to the radiation of the light from the irradiation section.

In such a liquid ejecting apparatus, the support member may be a cylindrical transportation drum that supports the medium on the peripheral surface thereof.

In such a liquid ejecting apparatus, it is preferable that the abutting member be a first roller that is rotated by abutting the surface of the one side of the medium, and the liquid ejecting apparatus further include: a second roller that is rotated by abutting the surface of the other side of the medium on the upstream side from the abutting roller in the transportation direction.

According to such a liquid ejecting apparatus, it is possible to increase the winding and holding amount of the medium to the transportation drum and it is possible to detect the presence or absence of the foreign matter on the surface of the other side of the medium.

It is clear that a method for detecting a foreign matter in a liquid ejecting apparatus including a transportation section that transports a medium in a transportation direction; a head that ejects liquid on the medium; a support member that supports the medium which is in a position facing the head while abutting a surface of one side of the medium; and a heat source that is disposed in a position facing the support member, includes: abutting the surface of the one side of the medium to an abutting member on an upstream side from the support member in the transportation direction; and performing detection of presence or absence of the foreign matter on a surface of the other side of the medium in an area of the medium which abuts the abutting member.

In the following embodiment, an ink-jet printer (hereinafter, referred to as a printer 1) will be described as an example of a liquid ejecting apparatus.

Embodiment

Configuration of Printer

Figure 2:
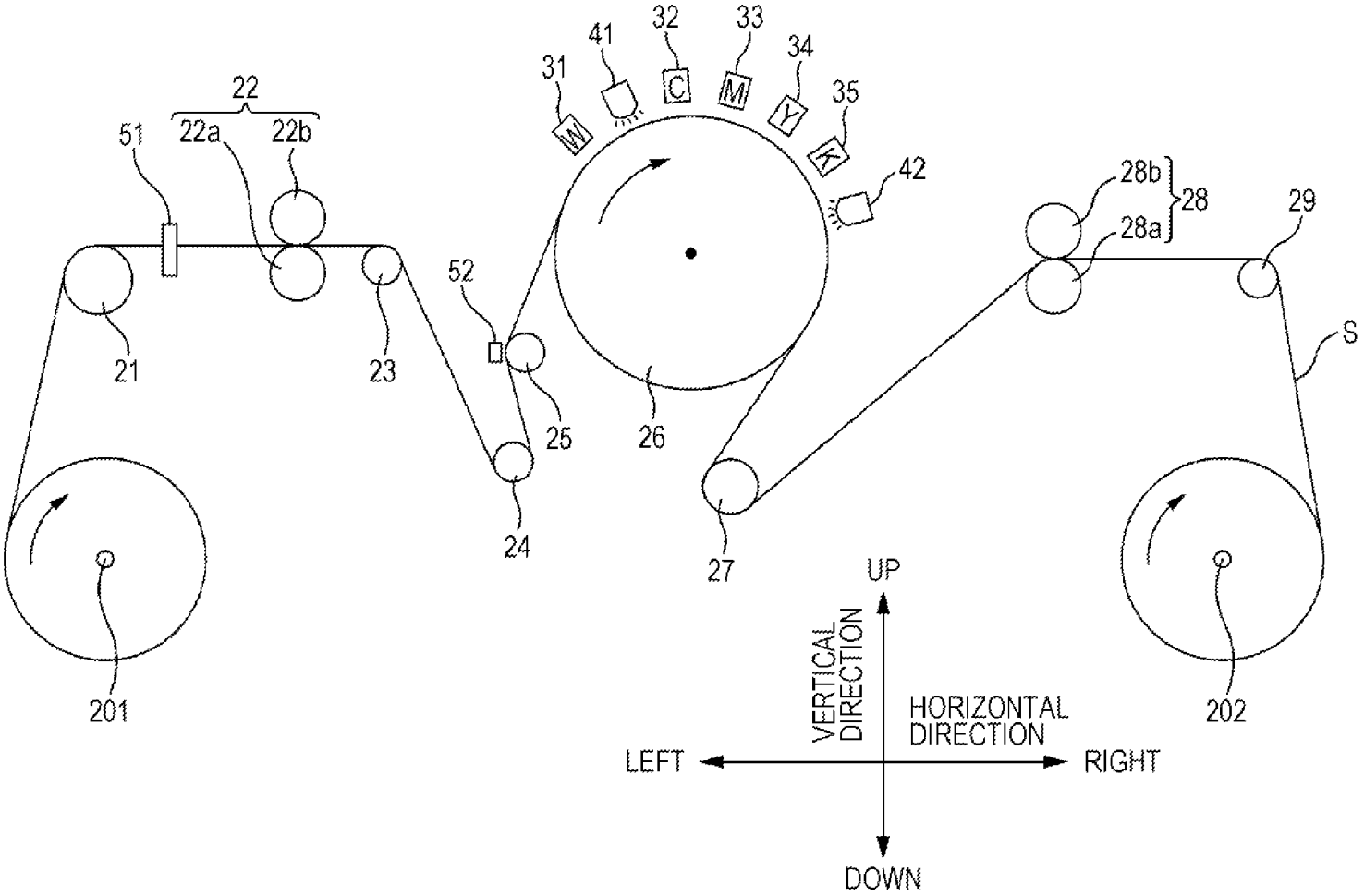
FIG. 2 is a schematic view of a transportation path including a printing area.

FIG. 1 is a block diagram of an overall configuration of the printer 1. Furthermore, FIG. 2 is a schematic view of a transportation path including a printing area.

The printer 1 is a printing apparatus for printing an image on a medium such as paper, cloth or film, and is communicably connected to a computer 110 that is an external apparatus. In addition, the embodiment is described using a paper (hereinafter, a rolled paper S (a continuous paper)) which is rolled in a roll shape, as an example of a medium on which the printer 1 records an image. Furthermore, in the following description, a face of one side (that is, a side facing a head) of the rolled paper S on which the printing is performed is referred to as a surface (corresponding to the surface of the other side) and a face of one side on which the printing is not performed is referred to as a back surface (corresponding to the surface of one side).

A printer driver is installed on the computer 110. The printer driver is a program for displaying a user interface on a display device (not illustrated) and for converting image data output from an application program to printing data. The printer driver is recorded in a recording medium (a computer-readable recording medium) such as a flexible disk FD or a CD-ROM. Otherwise, it is possible to download the printer driver to the computer 110 through the Internet. In addition, the program is configured of codes for realizing various functions.

Then, in order to print the image with the printer 1, the computer 110 outputs the printing data to the printer 1 depending on the image to be printed.

The printer 1 of the embodiment is a printing apparatus which prints the image on the medium by ejecting an ultraviolet ray-curable ink (hereinafter, UV ink) which is cured by irradiation of ultraviolet rays (hereinafter, UV), as an example of the liquid. The UV ink is ink including an ultraviolet ray-curable resin and is cured by an occurrence of photo polymerization reaction in the ultraviolet ray-curable resin when receiving the radiation of the UV. In addition, the printer 1 of the embodiment prints the image using the UV inks (color inks) of four colors of cyan, magenta, yellow and black, and the UV ink (background ink) of white for the background.

The printer 1 has a transportation unit 20, a head unit 30, an irradiation unit 40, a detector group 50 and a controller 60. The printer 1 receiving the printing data from the computer 110 that is the external apparatus prints the image on the medium depending on the printing data by controlling each unit (the transportation unit 20, the head unit 30 and the irradiation unit 40) using the controller 60. The controller 60 controls each unit and prints the image on the medium (the rolled paper S), based on the printing data received from the computer 110. Situations inside the printer 1 are monitored by the detector group 50 and the detector group 50 outputs a detection result to the controller 60. The controller 60 controls each unit, based on the detection result output from the detector group 50.

The transportation unit 20 transports the rolled paper S along a predetermined transportation path. As illustrated in FIG. 2, the transportation unit 20 has a reel-out shaft 201 on which the rolled paper S is wound and is rotatably supported, a relay roller 21, a first transportation roller 22, a relay roller 23, a reverse roller 24, an abutting roller 25, a transportation drum 26, a tension roller 27, a second transportation roller 28, a tension roller 29, and a rolled paper rewind driving shaft 202 which rewinds the rolled paper S passing through the tension roller 29.

The relay roller 21 is a roller which winds and holds the rolled paper S which is reeled out from the reel-out shaft 201 from a lower side (left lower side in the drawing) and transports the rolled paper S to the right side in a horizontal direction.

The first transportation roller 22 has a first driving roller 22*a* which is driven by a motor (not illustrated) and a first driven roller 22*b* disposed so as to face the first driving roller 22*a* across the rolled paper S. Position control or speed control of the rolled paper S is performed by driving the first driving roller 22*a*.

The relay roller 23 is a roller which winds and holds the rolled paper S which is passed through the first transportation roller 22 from the left side in the horizontal direction and transports the rolled paper S to the right lower side.

The reverse roller 24 (corresponding to a second roller) is a roller which reverses the transportation direction of the rolled paper S which is passed through the relay roller 23.

The abutting roller 25 (corresponding to an abutting member and first roller) is a roller which winds and holds the rolled paper S which is passed through the reverse roller 24 from the vertically lower side and sends the rolled paper S to the transportation drum 26. In addition, a material of the abutting roller 25 of the embodiment is iron.

The transportation drum 26 (corresponding to a support member) is a cylindrical transportation member and supports the rolled paper S on a peripheral surface thereof, and then transports the rolled paper S in the transportation direction. In addition, the transportation drum 26 faces each head or each UV irradiation section described below through the rolled paper S. In addition, the rolled paper S is transported so as to closely contact the transportation drum 26 with a predetermined tension. Furthermore, a material of the transportation drum 26 of the embodiment is aluminum.

The tension roller 27 is provided on a right lower side of the transportation drum 26 and sends the rolled paper S to the second transportation roller 28 by reversing the transportation direction of the rolled paper S which is passed through the transportation drum 26.

The second transportation roller 28 has a second driving roller 28*a* which is driven by a motor (not illustrated) and a second driven roller 28*b* which is disposed so as to face the second driving roller 28*a* across the rolled paper S. The second transportation roller 28 is a roller transporting a portion of the rolled paper S after the image is recorded by each head.

The tension roller 29 is a roller which winds and holds the rolled paper S which is passed through the second transportation roller 28 from left side in the horizontal direction, and then transports the rolled paper S to the rewind driving shaft 202 which is present on the lower side in the vertical direction.

As described above, a transportation path for transporting the rolled paper S is formed by moving the rolled paper S through each roller successively.

The head unit 30 ejects the UV ink on the rolled paper S. The head unit 30 forms dots on the rolled paper S and prints the image on the rolled paper S by ejecting the ink from each head with respect to the rolled paper S in transportation. Furthermore, each head of the head unit 30 of the printer 1 of the embodiment can form dots for a paper width of the rolled paper S that is the medium, at one time. In addition, as described above, in the embodiment, four color inks for forming the image and the white ink for the background are used as the UV inks. As illustrated in FIG. 2, in order from the upstream side in the transportation direction, each head of a white ink head 31 for ejecting the white ink, a cyan ink head 32 for ejecting the UV ink of cyan, a magenta ink head 33 for ejecting the UV ink of magenta, a yellow ink head 34 for ejecting the UV ink of yellow, and a black ink head 35 for ejecting the UV ink of black are provided so as to face the peripheral surface of the transportation drum 26. In addition, a detailed configuration of the head unit 30 is described below.

The irradiation unit 40 radiates the UV toward the UV ink landed on the medium. The dots formed on the medium are cured by receiving the radiation of the UV from the irradiation unit 40. The irradiation unit 40 of the embodiment includes an irradiation section 41 and an irradiation section 42. In addition, the irradiation section 41 and the irradiation section 42 include lamps (a metal halide lamp, a mercury lamp or the like) as light sources of the UV radiation, respectively.

The irradiation section 41 is provided between the white ink head 31 and the cyan ink head 32. That is, the irradiation section 41 is provided in the downstream side from the white ink head 31 in the transportation direction. Thus, the irradiation section 41 cures the dots (white dots) formed on the rolled paper S with the white ink head 31 by radiating the UV to the dots.

The irradiation section 42 is provided in the downstream side from the black ink head 35 in the transportation direction. In other words, the irradiation section 42 is provided in the downstream side from the head unit 30 in the transportation direction. Then, the irradiation section 42 cures color dots by radiating the UV on the image (color dots) formed on the rolled paper S with the cyan ink head 32, the magenta ink head 33, the yellow ink head 34 and the black ink head 35.

The detector group 50 includes an edge detection sensor 51, a foreign matter detection sensor 52 (corresponding to a detection section), a rotary type encoder (not illustrated), a paper detection sensor (not illustrated) or the like. The edge detection sensor 51 detects an edge of the rolled paper S in the width direction and detects meandering of the rolled paper S. The rotary type encoder detects an amount of the rotation of the first driving roller 22*a* or the second driving roller 28*a*. It is possible to detect an amount of the transportation of the medium, based on a detection result of the rotary type encoder. In addition, details of the foreign matter detection sensor 52 are described below.

The controller 60 is a control unit (a control section) for performing control of the printer 1. The controller 60 has an interface section 61, a CPU 62, a memory 63 and a unit control circuit 64. The interface section 61 performs transmitting and receiving the data between the computer 110 that is the external apparatus and the printer 1. The CPU 62 is an arithmetic processing unit for performing control of an entire printer. The memory 63 is intended to ensure an area for storing the program of the CPU 62 or a working area, and has a memory element such as RAM and EEPROM. In addition, the memory 63 has a resister for holding control information of flag or the like described below. The CPU 62 controls each unit through the unit control circuit 64 according to the program stored in the memory 63.

Configuration of Head

As described above, the printer 1 of the embodiment includes heads (the cyan ink head 32, the magenta ink head 33, the yellow ink head 34 and the black ink head 35) for four color inks and the head (the white ink head 31) ejecting the white ink for the background. Each head ejects the UV ink (the color ink) for each ink color to print the image.

In the embodiment, the white ink head 31, the cyan ink head 32, the magenta ink head 33, the yellow ink head 34 and the black ink head 35 have the same configuration as each other. Particularly, nozzles of each head are aligned with intervals (nozzle pitches) of 600 dpi (1/600 inches) along a nozzle column direction (a paper width direction). In addition, the nozzle column direction is a direction (the paper width direction of the rolled paper S) crossing the transportation direction of the rolled paper S. Therefore, it is possible to form the dots at a resolution of 600 dpi in the paper width direction. In addition, the resolution in the transportation direction can be adjusted by an ejection timing of the ink from the nozzles or the transport speed. In the embodiment, the dots are also formed at the resolution of 600 dpi in the transportation direction (the print resolution is 600×600 dpi).

Furthermore, a piezoelectric element is provided corresponding to each nozzle. Then, the ink is ejected from the nozzle corresponding to the piezoelectric element, based on the controller 60 applying the drive signal to the piezoelectric element.

White Ink

The printer 1 of the embodiment uses the white ink in addition to the color inks (yellow, magenta, cyan and black).

The white ink is ink for printing the background color (white) of the color image. As described above, with the white background the color image is easily viewable. In addition, the white ink contains a white pigment (equivalent to a sedimentary material) as a color material. For example, the white pigment includes metal oxide, barium sulfate and calcium carbonate or the like. For example, the metal oxide includes titanium dioxide, zinc oxide, silica, alumina, magnesium oxide or the like. Titanium dioxide is preferable among those materials from a point of view of excellence in whiteness.

Printing Process

When the printer 1 starts printing, the rolled paper S is disposed on the transportation path in a state where the rolled paper S is along the peripheral surface of the transportation drum 26 in advance. Then, the tension is applied to the rolled paper S by an output torque of the reel-out shaft 201, the rewind driving shaft 202 and the second transportation roller 28. Particularly, a predetermined tension is given to the reel-out portion of the rolled paper S by a brake torque of the reel-out shaft 201 depending on the roll diameter of the rolled paper S. The tension is detected with the tension roller 27 and the torque of a motor (not illustrated) of the second transportation roller 28 is controlled so as to give a predetermined tension in the portion of the printing area. The tension is detected with the tension roller 29 and the torque of a motor (not illustrated) of the rewind driving shaft 202 is controlled so as to give a predetermined tension in the rewind section. Each tension is determined depending on the roll diameter of the rolled paper S.

When the printer 1 receives the printing data from the computer 110, the controller 60 rotates a motor (not illustrated) of the first transportation roller 22 at a constant speed. As described above, in a state where the tension is applied to the rolled paper S, the rolled paper S is transported at a constant speed in the transportation direction by rotating the first transportation roller 22 at a constant speed. The transportation drum 26 is rotated in an arrow direction (transportation direction) following the transportation of the rolled paper S by a friction force with the rolled paper S.

The rolled paper S on the peripheral surface of the transportation drum 26 is transported in the transportation direction depending on the rotation of the transportation drum 26. In addition, the rolled paper S in the transportation closely comes in contact with the transportation drum 26. In the embodiment, since the position of each head is fixed, each head and the rolled paper S are relatively moved in the transportation direction by transporting the rolled paper S in the transportation direction.

The controller 60 intermittently ejects the ink from nozzles of each head of the head unit 30 while the rolled paper S is transported on the peripheral surface of the transportation drum 26, based on the image data received from the computer 110 (dot forming operation). Therefore, the dots are formed on the rolled paper S. Furthermore, the controller 60 makes each irradiation section of the irradiation unit 40 radiate the UV.

First, the controller 60 prints the white image (background image) for the background by ejecting the white ink from the white ink head 31. After that, the controller 60 cures the background image which is formed with the white ink head 31 by radiating the UV from the irradiation section 41.

Next, the controller 60 prints the cyan by ejecting the cyan ink from the cyan ink head 32 on the background image when the rolled paper S passes under the cyan ink head 32. Similarly, the controller 60 prints the magenta by ejecting the magenta ink from the magenta ink head 33 when the rolled paper S passes under the magenta ink head 33, prints the yellow by ejecting the yellow ink from the yellow ink head 34 when the rolled paper S passes under the yellow ink head 34, and prints the black by ejecting the black ink from the black ink head 35 when the rolled paper S passes under the black ink head 35. Thus, the color image is printed on the background image.

Finally, the controller 60 cures each dot on the rolled paper S by radiating the UV from the irradiation section 42.

In addition, the meandering of the rolled paper S is detected based on a detection result of the edge detection sensor 51. If the meandering occurs, the controller 60 performs the control so as to reduce the meandering by interlocking the reel-out shaft 201 and the relay roller 21.

Foreign Matter Detection Sensor 52

Figure 3:
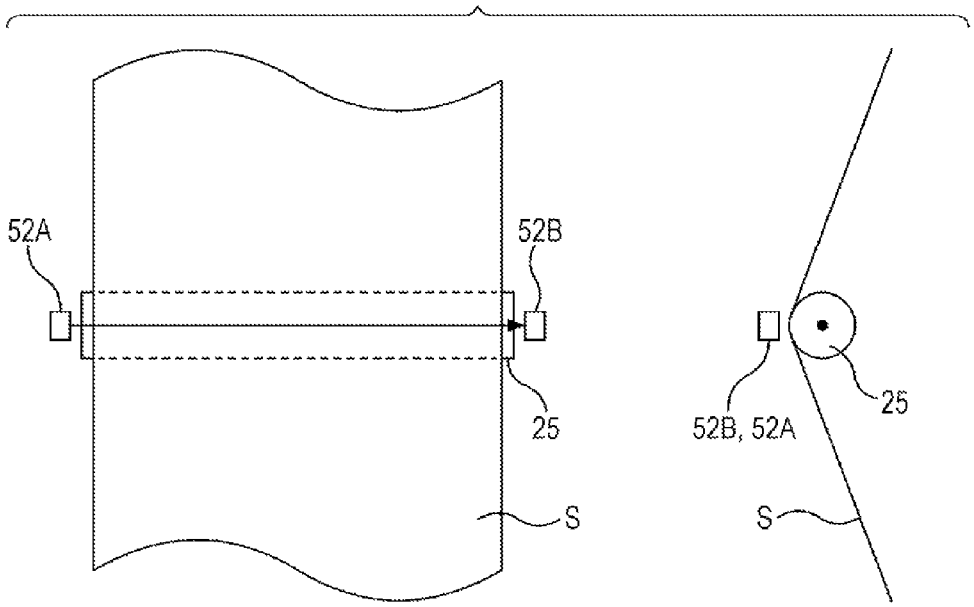
FIG. 3 is an explanatory view of a foreign matter detection sensor.

FIG. 3 is an explanatory view of the foreign matter detection sensor 52. A left side view of FIG. 3 is a view seen from the surface side of the rolled paper S and a right side view is a view seen from the lateral side.

The foreign matter detection sensor 52 of the embodiment is configured of a light emitting side sensor (hereinafter, also referred to as a light emitting section) 52A and a light receiving side sensor (hereinafter, also referred to as a light receiving section) 52B.

The light emitting section 52A and the light receiving section 52B are provided on the edges of the rolled paper S in the paper width direction on the surface side of the rolled paper S, respectively, so as to pinch the rolled paper S.

The light emitting section 52A radiates laser light toward the light receiving section 52B.

The light receiving section 52B receives the laser light radiated from the light emitting section 52A.

Then, the foreign matter detection sensor 52 detects presence or absence of the foreign matter depending on an amount of received light of the laser light which is radiated from the light emitting section 52A and received in the light receiving section 52B.

Figure 4A:
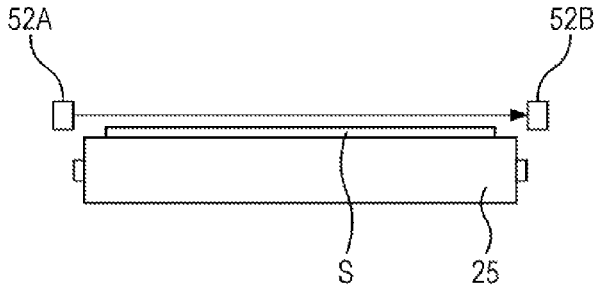
FIGS. 4A and 4B are schematic diagrams describing detection operation of the presence or absence of the foreign matter with the foreign matter detection sensor.
Figure 4B:
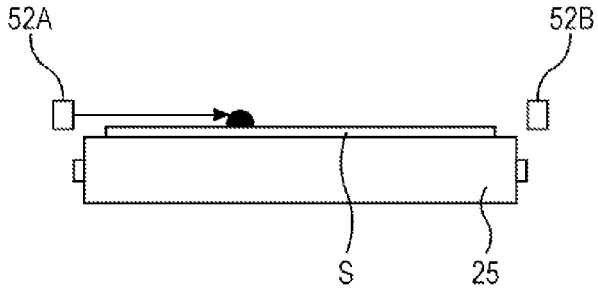

FIGS. 4A and 4B are schematic diagrams describing detection operation of the presence or absence of the foreign matter with the foreign matter detection sensor 52.

In FIG. 4A, since the foreign matter is not present on the rolled paper S, the laser light radiated from the light emitting section 52A can be received in the light receiving section 52B. As described above, it is possible to determine that the foreign matter is not present on the rolled paper S by receiving the laser light in the light receiving section 52B.

On the other hand, in FIG. 4B, the foreign matter (paper jam, dusts or the like) is present on the rolled paper S. In this case, the laser light radiated from the light emitting section 52A is shielded by the foreign matter and does not reach the light receiving section 52B. If the laser light radiated from the light emitting section 52A cannot be received in the light receiving section 52B, or if the light received in the light receiving section 52B is less than a threshold, it is possible to determine that the laser light is shielded between the light emitting section 52A and the light receiving section 52B. As described above, the foreign matter detection sensor 52 detects the presence or absence of the foreign matter (the paper jam, the dusts or the like) on the rolled paper S, based on a result the received light in the light receiving section 52B. In addition, if the foreign matter is present on the rolled paper S, there is a concern that the head may be damaged by colliding with the foreign matter. Thus, when the foreign matter detection sensor 52 detects the foreign matter, the controller 60 stops the transportation of the rolled paper S before the head collides with the foreign matter.

Disposition of Foreign Matter Detection Sensor 52

In order to prevent the damage of each head of the head unit 30 due to the foreign matter, it is preferable that the detection of the presence or absence of the foreign matter be performed in the upstream side from the head unit 30 in the transportation direction. However, if the detection position of the foreign matter is positioned too far from the head unit 30, there is a concern that the foreign matter may attach to the rolled paper S in the transportation of the rolled paper S after the detection is performed. That is, it is preferable that the detection of the foreign matter be performed in a position close to the head unit 30 as much as possible on the upstream side from the head unit 30 in the transportation direction.

In the position close to the head unit 30, the transportation drum 26 is heated by receiving the radiation of the UV from the irradiation unit 40 (the irradiation section 41 and the irradiation section 42) and by generating the heat due to chemical reaction of the UV ink, and temperature change is great (the temperature rises) by releasing the heat from the transportation drum 26. Thus, if the presence or absence of the foreign matter of the rolled paper S is detected by providing the foreign matter detection sensor 52 in the position facing the transportation drum 26 which is close to the head unit 30, there is a concern that detection accuracy of the foreign matter may be deteriorated by deterioration of sensor accuracy due to the temperature change. For example, there is a concern that the apparatus may be stopped by erroneous detection that the foreign matter is present even though the foreign matter is not present. Furthermore, there is a concern that the head (each head of the head unit 30) is damaged without stopping the apparatus because the foreign matter cannot be detected even though the foreign matter is present. Thus, in the embodiment, the abutting roller 25 abutting the rolled paper S (more particularly, the back surface of the rolled paper S) is provided on the upstream side from the transportation drum 26 in the transportation direction. Then, the detection of the foreign matter on the rolled paper S is performed in an area where the abutting roller 25 abuts the rolled paper S. Since the abutting roller 25 is positioned far from the irradiation unit 40 and the transportation drum 26 causing the temperature change, and from the area where the chemical reaction of the UV ink occurs, the temperature change is unlikely to occur in a position facing the abutting roller 25 compared to the position facing the transportation drum 26 close to the head unit 30. Therefore, it is possible to suppress a decrease in the detection accuracy due to the temperature change by disposing the foreign matter detection sensor 52 in the position facing the abutting roller 25.

In addition, as described above, since the transportation drum 26 is made of aluminum and a linear expansion coefficient is large (linear expansion coefficient: 23 [1/K]), an amount of change in the thickness (in this case, an amount of the change in expansion or contraction of the diameter) due to the temperature change is large. Thus, the thickness of the transportation drum 26 is changed due to the temperature change and then change in a gap between the head and the peripheral surface of the transportation drum 26 occurs. Thus, the threshold of the foreign matter detection sensor 52 is set in anticipation of the amount of the change in the thickness of the transportation drum 26 due to the temperature change. Similarly, if the thickness of the abutting roller 25 is changed, it is necessary to set the value of the threshold of the abutting roller 25 in anticipation of the amount of the change in the thickness of the abutting roller 25 as the threshold of the foreign matter detection sensor 52. Here, if the amount of the change in thickness of the abutting roller 25 is large, it is necessary for the threshold of the foreign matter detection sensor 52 to be set low, compared to a case where the amount of the change in thickness of the abutting roller 25 is small. In other words, if the amount of the change in the thickness of the abutting roller 25 is large, the detection of the foreign matter has to be performed by assuming that small foreign matter may come in contact with the head, compared to a case where the amount of the change in the thickness of the abutting roller 25 is small. Therefore, a case where the apparatus is stopped increases even though the foreign matter does not actually come in contact with the head. Then, in the abutting roller 25 of the embodiment, the roller made of iron (linear expansion coefficient: 11.8 [1/K]) having the linear expansion coefficient smaller than that of aluminum is used. Thus, in the abutting roller 25, the extension or contraction of the diameter due to the temperature change is small, compared to a case where the roller is made of the aluminum. That is, it is possible to set the threshold of the foreign matter detection sensor 52 highly, compared to a case where the abutting roller 25 is made of the aluminum, and it is possible to reduce a case where the apparatus is stopped if the foreign matter does not actually contact the head. Incidentally, the reason for using the transportation drum 26 made of aluminum is to reduce the weight thereof because the transportation drum 26 is much larger than the abutting roller 25.

Figure 5A:
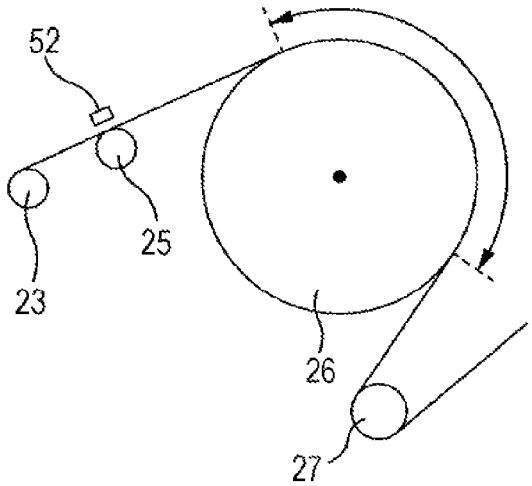
FIGS. 5A to 5C are views describing disposition of the foreign matter detection sensor.
Figure 5B:
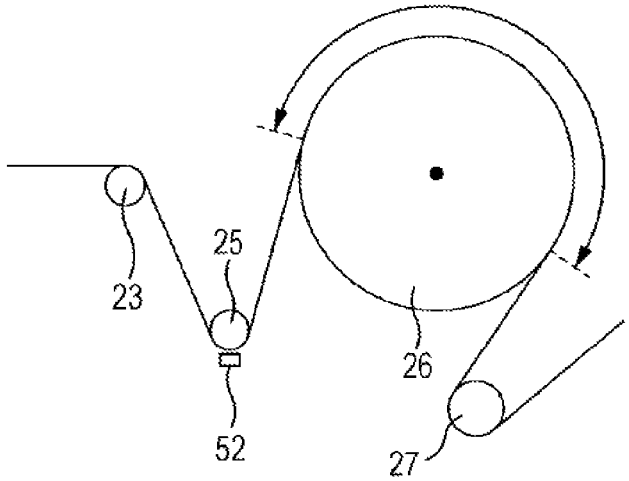
Figure 5C:
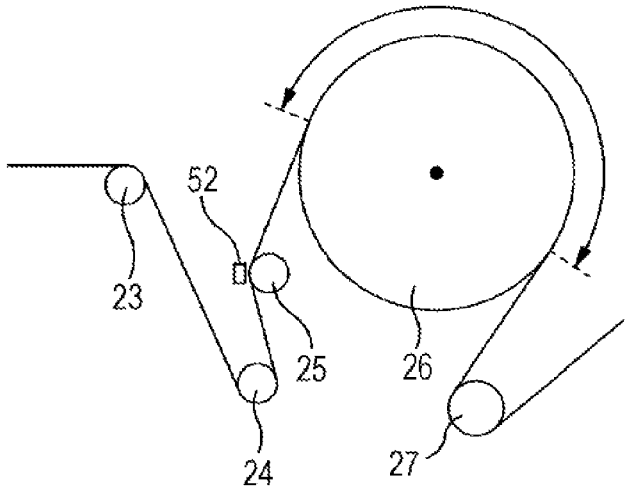

FIGS. 5A to 5C are views describing disposition of the foreign matter detection sensor 52.

In FIG. 5A, the abutting roller 25 is disposed between the relay roller 23 and the transportation drum 26 without providing the reverse roller 24. Then, the foreign matter detection sensor 52 is disposed in a position facing an area of the rolled paper S which abuts the abutting roller 25. In the case of FIG. 5A, a winding and holding amount (a range illustrated in an arrow in the view) of the rolled paper S in the peripheral surface of the transportation drum 26 is small. Thus, since the area in which the transportation drum 26 closely comes in contact with the rolled paper S is narrow, there is a problem that follow-up performance of the transportation drum 26 and the rolled paper S is deteriorated. In addition, there is a problem that the number of heads or irradiation sections which can be disposed to face the transportation drum 26 is limited.

In FIG. 5B, the abutting roller 25 is disposed on the lower side from the relay roller 23 in the vertical direction. Then, the foreign matter detection sensor 52 is disposed in a position facing an area of the rolled paper S which abuts the abutting roller 25. In the case of FIG. 5B, it is possible to increase the winding and holding amount (a range illustrated in an arrow in the view) more than the case of FIG. 5A. However, in the case of FIG. 5B, the surface of the rolled paper S abuts the abutting roller 25. That is, the foreign matter detection is performed on the back surface of the rolled paper S and the foreign matter detection cannot be performed on the surface of the rolled paper S.

FIG. 5C is a view illustrating the embodiment (see FIG. 2) and the reverse roller 24 is provided on the upstream side from the abutting roller 25 in the transportation direction. That is, two rollers of the reverse roller 24 and the abutting roller 25 are provided on the upstream side from the transportation drum 26 in the transportation direction. In this case, it is possible to perform the foreign matter detection on the surface of the rolled paper S in the area in which the rolled paper S abuts the abutting roller 25. In addition, it is possible to increase the winding and holding amount of the rolled paper S to the peripheral surface of the transportation drum 26.

As described above, it is possible to increase the winding and holding amount of the rolled paper S to the peripheral surface of the transportation drum 26 and it is possible to enhance the detection accuracy of the presence or absence of the foreign matter on the surface of the rolled paper S by providing the two rollers on the upstream side from the transportation drum 26 in the transportation direction.

As described above, the printer 1 of the embodiment includes the transportation unit 20 transporting the rolled paper S in the transportation direction, each head ejecting the UV ink on the rolled paper S, the transportation drum 26 supporting the rolled paper S facing each head, and the irradiation sections 41 and 42 radiating the UV on the rolled paper S on the transportation drum 26. In addition, the printer 1 of the embodiment includes the abutting roller 25 abutting the back surface of the rolled paper S on the upstream side from the transportation drum 26 in the transportation direction, and the foreign matter detection sensor 52 performing the detection of the presence or absence of the foreign matter on the surface of the rolled paper S in the area of the rolled paper S which abuts the abutting roller 25.

Therefore, since the presence or absence of the foreign matter on the surface of the rolled paper S can be detected without receiving influence of the temperature change due to the irradiation unit 40, the transportation drum 26, the chemical reaction of the UV ink or the like, it is possible to improve the detection accuracy of the foreign matter.

Other Embodiments

The printer or the like is described as one embodiment but the above embodiment is intended to facilitate the understanding of the invention and is not intended to limit the invention. The invention can be altered and improved without deviating from the spirit thereof, and it goes without saying that equivalents thereof are included in the invention. Particularly, embodiments described below are also included in the invention.

Printer

In the above embodiment, the printer is described as an example of the liquid ejecting apparatus but the invention is not limited to the embodiment. For example, the technique similar to the embodiment may be applied to various liquid ejecting apparatuses utilizing ink jet technique such as a color filter manufacturing apparatus, a dyeing apparatus, a micro-processing apparatus, a semiconductor manufacturing apparatus, a surface processing apparatus, a 3D modeling machine, a liquid vaporizer, an organic EL manufacturing apparatus (particularly, a polymer EL manufacturing apparatus), a display manufacturing apparatus, a film forming apparatus, a DNA chip manufacturing apparatus.

In addition, in the above embodiment, the computer 110 is included as the external apparatus but the computer 110 may be included as a configuration element of the printer 1.

In addition, in the above embodiment, the printer is configured such that a plurality of heads are disposed to face the peripheral surface of the cylindrical transportation drum 26 and the image is formed by ejecting the ink on the medium from each head while transporting the medium (the rolled paper S) along the peripheral surface of the transportation drum 26, but the invention is not limited to the embodiment.

For example, the printer (a so-called serial printer) may be configured such that the image is formed by alternately repeating the dot forming operation which forms the dot column along the moving direction and the transportation operation (the moving operation) which transports the medium in the transportation direction that is the nozzle column direction while moving the head unit in the moving direction crossing the nozzle column direction. Furthermore, for example, the printing apparatus (a so-called line printer) may be configured such that the head which is longer than the paper width is fixed on the transportation path and the printing is performed on the medium by intermittently ejecting the ink from the head while transporting the medium in the transportation direction. For these printers, a planar platen (a support member) is used as a member for supporting the medium facing the head. Even in this case, the abutting member (for example, the roller) which abuts the back surface of the medium and the foreign matter detection sensor which detects the foreign matter on the surface of the medium in the area of the medium which abuts the abutting member may be provided on the upstream side from the platen in the transportation direction.

Ejecting Method

In the above embodiment, the ink is ejected using the piezoelectric element. However, the method for ejecting the liquid is not limited to the embodiment. For example, other methods including a method in which bubbles are generated in the nozzle by heat or the like may be utilized.

Medium

In the above embodiment, the rolled paper S is described as an example of the medium but the invention is not limited to the embodiment, and for example, the medium may be a cut paper, film and cloth.

Head

In the printer 1 of the above embodiment, the head unit 30 includes five heads (four heads for the color image and one head for the background image) but the invention is not limited to the embodiment and the head unit 30 may include four heads or less, or six heads or more. In addition, the configuration of each head is not limited to the above embodiment. Furthermore, it is preferable that the winding and holding amount of the rolled paper S to the transportation drum 26 be as large as the number of heads (and irradiation sections) is great.

Ink

Since the above embodiment is an embodiment of the printer, the ink is used as the liquid but the liquid ejected from the nozzle is not limited to the ink. For example, liquid (also including water) containing a metallic material, an organic material (particularly, polymer material), a magnetic material, a conductive material, a wiring material, a film forming material, an electronic ink, a machining liquid, a genetic solution or the like may be ejected from the nozzle.

In the printer 1 of the above embodiment, the ink (the UV ink) which is cured by receiving radiation of the UV is used but the ink may not be the UV ink.

In addition, in the printer 1 of the above embodiment, four color inks of cyan, magenta, yellow and black are used but other color inks (for example, light cyan, light magenta or the like) may be further used.

In addition, in the printer 1 of the embodiment, the background image is printed but the background image may not be present. In addition, ink (for example, a clear ink or the like) in addition to the white ink may be further used.

Irradiation Section

In the above embodiment, the light source of the irradiation sections 41 and 42 is the lamp but the invention is not limited to the embodiment. For example, the light source may be an LED.

In the above embodiment, the light source is not disposed between the heads ejecting the color inks. However, a light source for pre-curing or curing may be disposed between each of heads.

In addition, if the ink is not the UV ink, the irradiation sections 41 and 42 may not be provided. In this case, a hot air blow-out section blowing hot air on the rolled paper S, a heater applying the heat to the rolled paper or the like may be included for facilitating dry of the ink. Even in this case, since there is a concern that the temperature change may occur, it is preferable that the abutting roller 25 and the foreign matter detection sensor 52 be provided on the upstream side from the transportation drum 26 in the transportation direction.

Foreign Matter Detection Sensor

In the above embodiment, the foreign matter detection sensor 52 uses the laser light when detecting the foreign matter but the invention is not limited to the embodiment. For example, the sensor may use light such as ultraviolet light, visible light and electromagnetic waves.

In addition, the foreign matter detection sensor 52 of the above embodiment includes the light emitting section 52A and the light receiving section 52B but the invention is not limited to the embodiment. The foreign matter detection sensor 52 may be one that can detect the presence or absence of the foreign matter on the surface of the medium. For example, a contact-type sensor may be used.

The entire disclosure of Japanese Patent Application No. 2013-006422, filed Jan. 17, 2013 is expressly incorporated by reference herein.

What is claimed is:

1. A liquid ejecting apparatus comprising:

a transportation section that transports a medium in a transportation direction;

a head that ejects liquid on the medium;

a support member that supports the medium which is in a position facing the head while abutting a surface of one side of the medium;

a heat source that is disposed in a position facing the support member;

an abutting member that abuts the surface of the one side of the medium on an upstream side from the support member in the transportation direction; and a detection section that detects presence or absence of foreign matter on a surface of the other side of the medium in an area of the medium which abuts the abutting member.

2. The liquid ejecting apparatus according to claim 1, wherein a thermal expansion coefficient of the abutting member is smaller than that of the support member.

3. The liquid ejecting apparatus according to claim 1, wherein a material of the support member is aluminum and a material of the abutting member is iron.

4. The liquid ejecting apparatus according to claim 1, wherein the liquid is cured by receiving radiation of light, and wherein the liquid ejecting apparatus further comprises: an irradiation section of the light as the heat source.

5. The liquid ejecting apparatus according to claim 1, wherein the support member is a cylindrical transportation drum that supports the medium on the peripheral surface thereof.

6. The liquid ejecting apparatus according to claim 5, wherein the abutting member is a first roller that is rotated by abutting the surface of the one side of the medium, and wherein the liquid ejecting apparatus further comprises: a second roller that is rotated by abutting the surface of the other side of the medium on the upstream side from the abutting roller in the transportation direction.

7. A method for detecting a foreign matter in a liquid ejecting apparatus including a transportation section that transports a medium in a transportation direction;

a head that ejects liquid on the medium;

a support member that supports the medium which is in a position facing the head while abutting a surface of one side of the medium; and a heat source that is disposed in a position facing the support member, the method comprising:

abutting the surface of the one side of the medium to an abutting member on an upstream side from the support member in the transportation direction; and performing detection of presence or absence of the foreign matter on a surface of the other side of the medium in an area of the medium which abuts the abutting member.

8. A liquid ejecting apparatus comprising:

a transportation section that transports a medium in a transportation direction;

a head that ejects liquid on the medium;

a support member that supports the medium which is in a position facing the head while abutting a surface of one side of the medium;

an abutting member that abuts the surface of the one side of the medium on an upstream side from the support member in the transportation direction; and a detection section that can detect presence or absence of foreign matter on a surface of the other side of the medium in an area of the medium which abuts the abutting member.

9. The liquid ejecting apparatus according to claim 8, wherein a thermal expansion coefficient of the abutting member is smaller than that of the support member.

* * * * *